US007383891B2

(12) United States Patent
Fay et al.

(10) Patent No.: US 7,383,891 B2
(45) Date of Patent: Jun. 10, 2008

(54) HYDRAULIC SET PERMANENT PACKER WITH ISOLATION OF HYDRAULIC ACTUATOR AND BUILT IN REDUNDANCY

(75) Inventors: Peter Fay, Houston, TX (US); Timothy Wootan, Houston, TX (US); Paul Zutz, Houston, TX (US); John Baugh, College Station, TX (US); Kenneth Almond, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 204 days.

(21) Appl. No.: 11/209,982

(22) Filed: Aug. 23, 2005

(65) Prior Publication Data

US 2006/0102361 A1 May 18, 2006

Related U.S. Application Data

(60) Provisional application No. 60/603,900, filed on Aug. 24, 2004.

(51) Int. Cl.
*E21B 33/129* (2006.01)

(52) U.S. Cl. ..... 166/387; 166/120; 166/191

(58) Field of Classification Search ..... 166/387, 166/118, 120, 191
See application file for complete search history.

(56) References Cited

U.S. PATENT DOCUMENTS

| | | | | |
|---|---|---|---|---|
| 3,659,647 | A | 5/1972 | Brown | |
| 4,018,272 | A * | 4/1977 | Brown et al. | 166/119 |
| 4,289,200 | A * | 9/1981 | Fisher, Jr. | 166/120 |
| 4,708,202 | A | 11/1987 | Sukup | |
| 4,869,320 | A | 9/1989 | Kamilos | |
| 4,903,777 | A * | 2/1990 | Jordan et al. | 166/387 |
| 6,315,041 | B1 | 11/2001 | Carlisle et al. | |

* cited by examiner

*Primary Examiner*—William P Neuder
(74) *Attorney, Agent, or Firm*—Madan, Mossman & Sriram, P.C.

(57) ABSTRACT

A packer includes one or more anchors for securing the packer in a wellbore and a pair of seal elements that form a fluid seal. The packer assembly is hydraulically set and, thus, it can be located at any desired position within the wellbore. The packer assembly is secured within the wellbore by a staged setting process through use of shear pins that have increasingly stepped shear values. Redundancy in packer sealing is provided by the use of two seal elements to establish fluid sealing. The design of the packer assembly also provides hydraulic isolation of the actuating portions of the packer assembly upon setting.

20 Claims, 6 Drawing Sheets

HYDRAULIC SET PERMANENT PACKER WITH ISOLATION OF HYDRAULIC ACTUATOR AND BUILT IN REDUNDANCY

CROSS-REFERENCE TO RELATED APPLICATIONS

This application takes priority from U.S. Provisional Application Ser. No. 60/603,900 filed on Aug. 24, 2004.

BACKGROUND OF THE INVENTION

1. Field of the Invention

The invention relates generally to improved methods and devices for setting a packer assembly within a wellbore.

2. Description of the Related Art

Packer assemblies are used to secure production tubing within a wellbore. These assemblies typically include an elastomeric seal that is radially expandable to engage the wellbore surface and may also include a set of slips that have serrated or toothed portions that, when set, bitingly engage the wellbore surface. Packer assemblies of this type are often used when it is desired to "tie back" from a section of casing that has been previously set by cementing into the wellbore. There are potential problems in locating and setting the packer assembly in this instance. Typically, the upper end of the previously set casing has a liner hanger with a seal bore. It is desired to land the packer assembly into this seal bore and then set it to secure it within the wellbore. One potential solution would be to use a mechanically set packer. Unfortunately, mechanical setting of this type typically requires that the packer assembly be landed onto a structure (i.e., the liner hanger) in the wellbore. Thus, the packer assembly will be located immediately atop the liner hanger when it may be desired to locate the packer assembly at a distance above the liner hanger.

Additionally, it is desired to have an improved manner and arrangement for setting of a packer assembly within the wellbore to ensure that the slips are well set to structurally anchor the packer assembly in place and that proper fluid seals are established within the annulus of the wellbore.

The present invention addresses the problems of the prior art.

SUMMARY OF THE INVENTION

In aspects, the present invention provides a robust packer assembly having features that provide long-term protection against fluid leaks in a wellbore tubular such as a casing or liner. In one embodiment, the packer includes a body, two axially spaced apart seal elements that form a hydraulic chamber or cavity upon being set, and an anchor that secure the packer in the wellbore. The packer includes a hydraulic actuator that sets the seal elements and the anchor. Advantageously, the hydraulic chamber formed by the seal elements substantially isolates any fluid that potentially leaks out of the hydraulic actuator. In one mode of deployment, the seal elements are sequentially set. For example, frangible elements such as shear pins having appropriately selected shear strengths can be use to retain the seal and anchor elements. To set the seals and anchor elements, fluid pressure in the wellbore can be progressively increased to sequentially break the shear pins and set the seal and anchor elements. In one embodiment, the slip anchor includes two sets of slips located axially between the first and second seal elements. In certain embodiments, the first seal element, the and second seal element, and the anchor are adapted to be retracted or otherwise disengaged from the adjacent wellbore tubular. After these elements are unset, the packer can be retrieved using a suitable work string.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein:

FIG. 1 is a schematic, cross-sectional view of an exemplary wellbore having a lower cased portion, liner hanger and a packer assembly, constructed in accordance with the present invention, being run in.

DETAILED DESCRIPTION OF THE INVENTION

Figure 1:
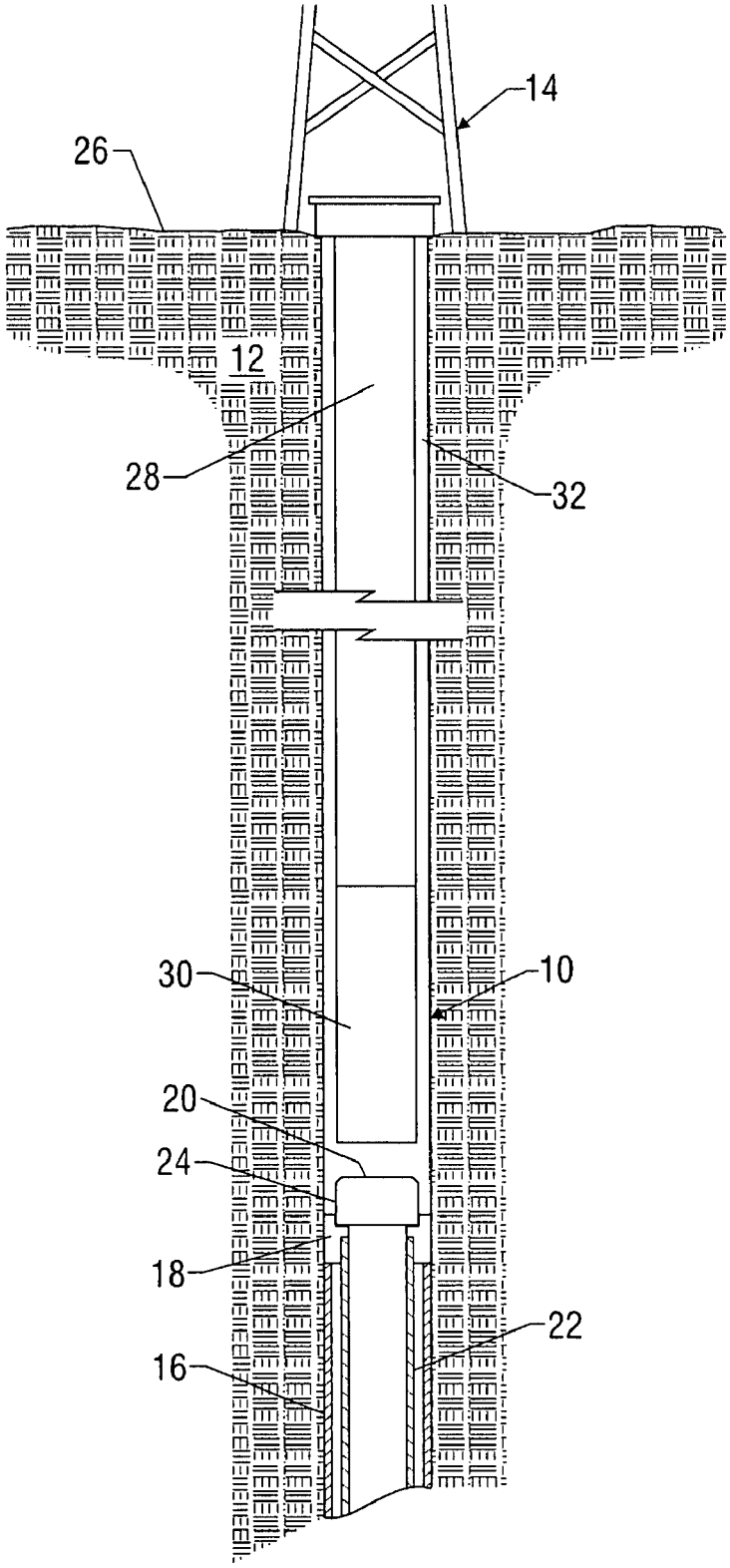

FIG. 1 depicts a wellbore 10 that extends through the earth 12 from a wellhead 14. A lower portion of the wellbore 10 contains a section that has been lined with casing 16. A liner hanger 18 is located atop the casing 16 and presents an upward tubular portion 20. Although shown schematically in FIG. 1, those of skill in the art will understand that the liner hanger 18 is typically set with slips (not shown). A liner 22 for a production tubing string is suspended from the liner hanger 18 and extends downward to a production zone (not shown). A seal bore 24 is defined between the tubular portion 20 and the wall of the wellbore 10. Those of skill in the art will understand that, although the exemplary wellbore 10 that is depicted is a land-based wellbore, it might also be a subsea wellbore. In addition, while the wellbore 10 is shown as being vertically disposed through the earth 12, it also may have deviated or horizontal portions.

In this instance, it is desired to tie back the lower production tubing string to provide a flowline to the surface 26. To accomplish this, a production tubing string 28 is lowered into the wellbore 10 from the wellhead 14. At the lower end of the production tubing string 28 includes a packer assembly 30, in accordance with the present invention. An annulus 32 is defined between the production tubing string 28 and the wall of the wellbore 10.

Figure 2A:
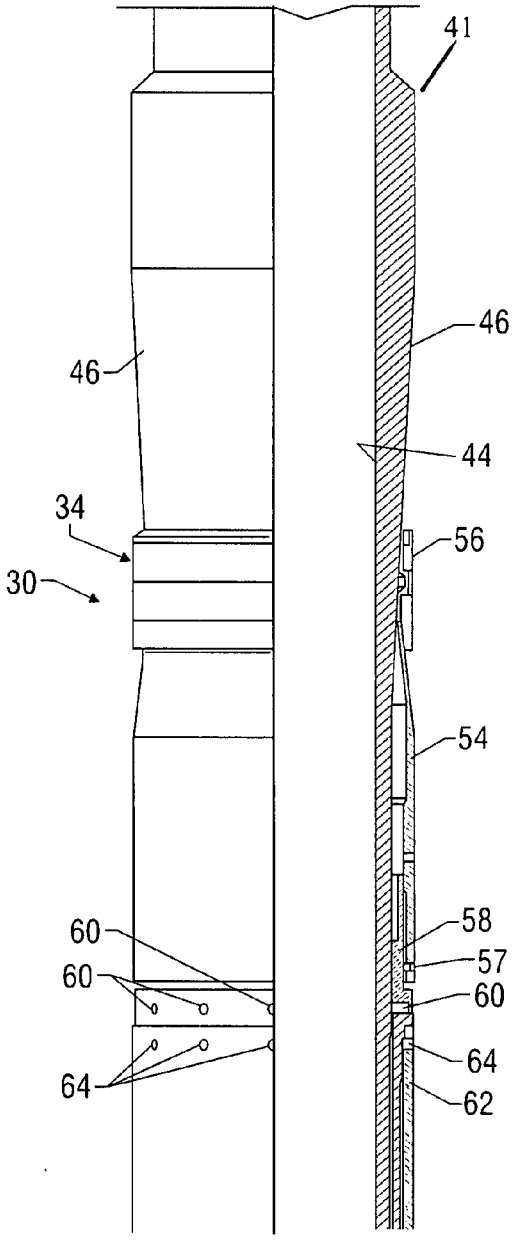
FIGS. 2A-2F are a side, partial cross-section, of an exemplary packer assembly constructed in accordance with the present invention.
Figure 2B:
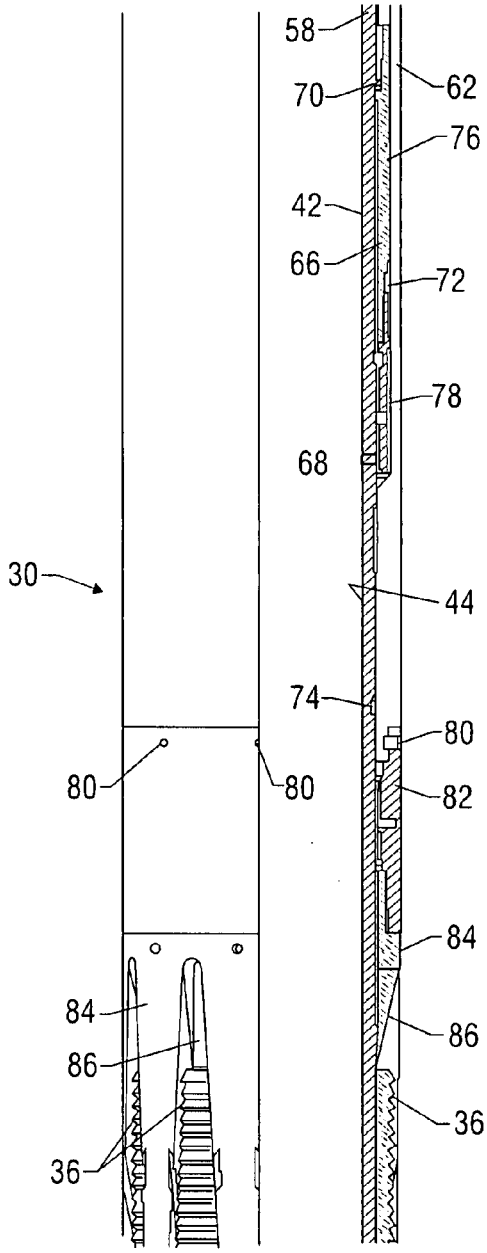
Figure 2C:
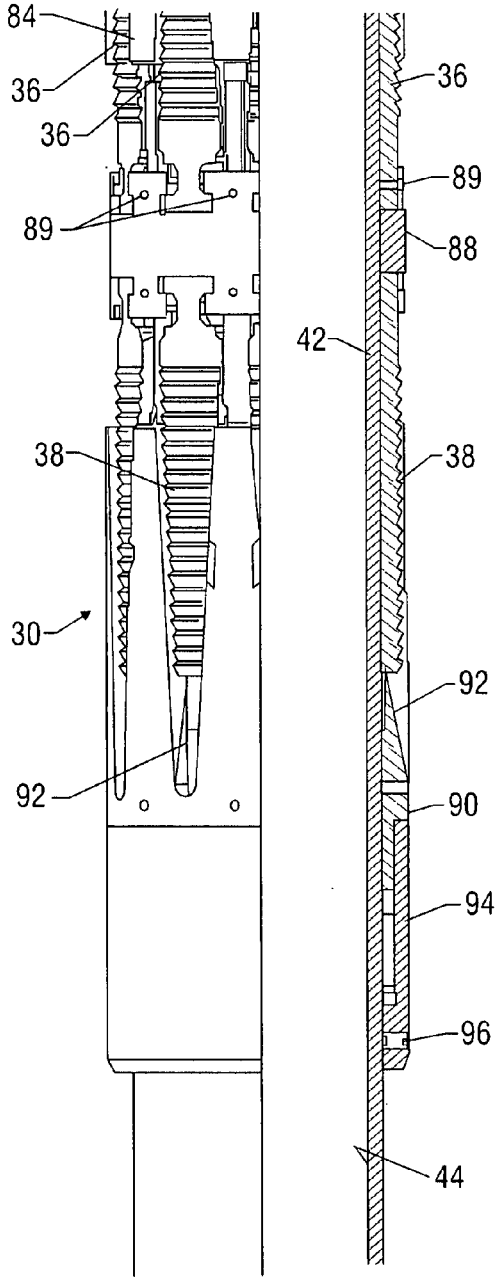
Figure 2D:
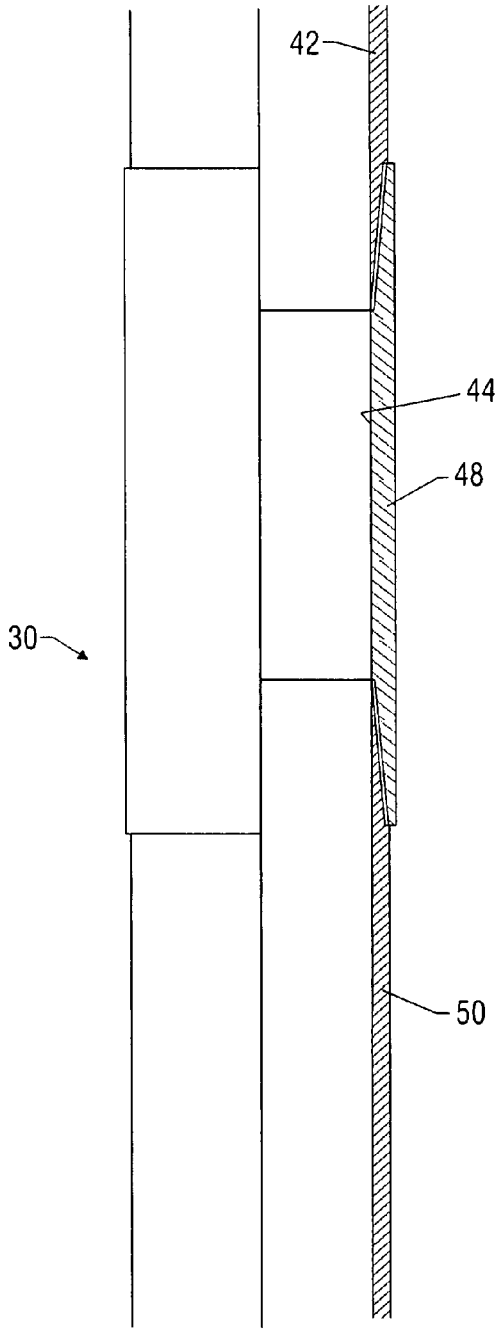
Figure 2E:
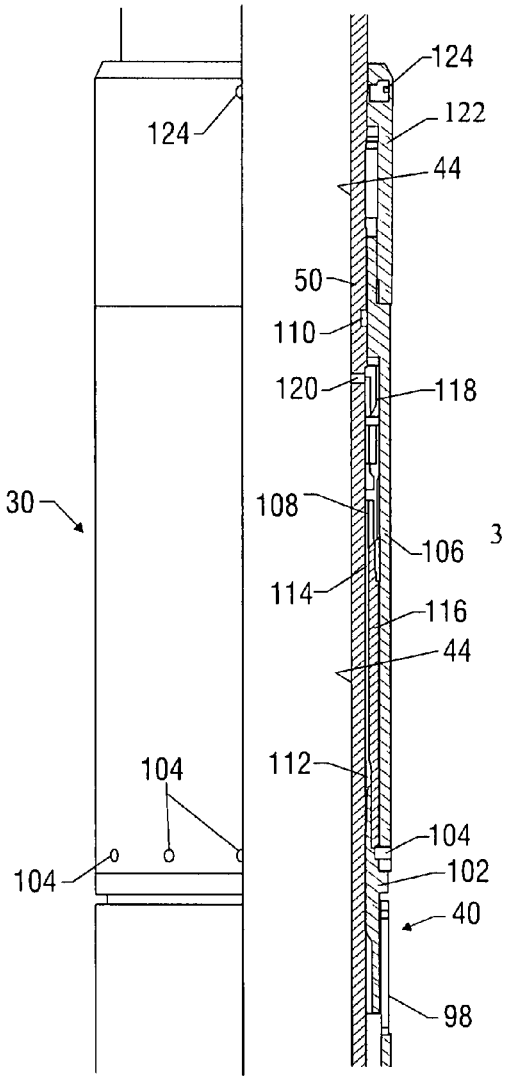
Figure 2F:
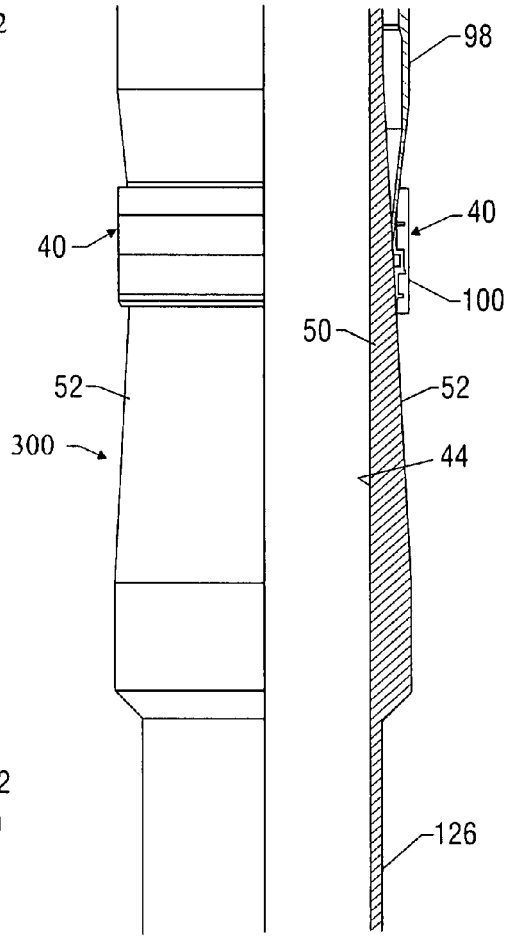
Figure 5:
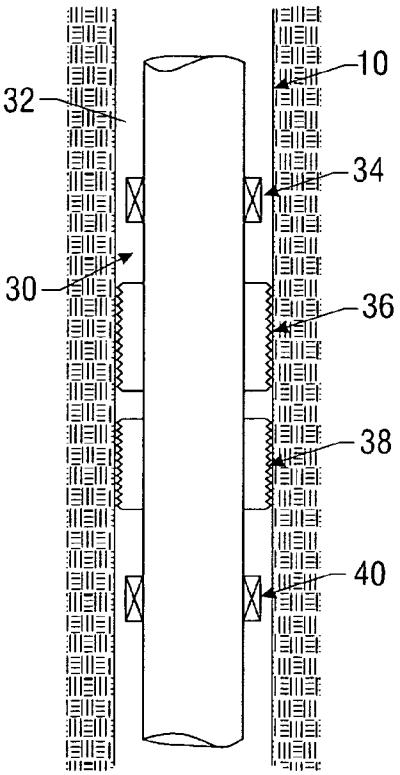
FIG. 5 is a schematic view of the packer assembly now in a second, partially set position.

FIGS. 2A-2F provide a detailed view of the components of the packer assembly 30 with the upper portion of the packer assembly 30 shown in FIG. 2A and the lower portion of the packer assembly 30 shown in FIG. 2F. In general terms, the packer assembly 30 includes an upper seal assembly 34, an anchor that includes an upper and lower slip elements 36, 38, and a lower seal assembly 40. A hydraulic actuator 41, discussed in further detail below, is used to set the anchor and/or the seals. Advantageously, the upper and lower seals 34, 40 form a hydraulic chamber that can capture or isolate fluid therein. As is known, hydraulic actuators include seals to retain pressurized fluid. By positioning a hydraulic actuator axially between the seals 34, 40, it will be seen that the failure of any hydraulic actuator seals will direct the leaking fluid into the hydraulic chamber, which then isolates or substantially isolates the fluid leak. Thus, it should be appreciated that embodiments of the present invention provide a redundant or back-up seal for the hydraulic actuator seals.

Beginning at the upper end, the packer assembly 30 includes an upper inner mandrel 42. A central axial flowbore 44 is defined within packer assembly 30 by the inner mandrel 42 and those components axially secured thereto, which make up the packer assembly body. The upper end (not shown) of the mandrel 42 is secured to the production tubing string 28 by threaded connection, as is known in the art. The outer surface of the mandrel 42 features a ramped surface 46. At its lower end (FIG. 2D), the mandrel 42 is threadedly secured to a collar 48 which, in turn is secured to a lower inner mandrel 50. The lower mandrel 50 also presents a sloped outer surface 52. The lower end (not shown) of the lower mandrel 50 is shaped and sized to reside within the seal bore 24 that is defined at the upper end of the liner hanger 18.

Returning to the upper portions of the packer assembly 30, it is noted that the upper seal assembly 34 is preferably of the type known as a "ZX seal," which is available commercially from Baker Oil Tools of Houston, Tex. Other seals or seal types, however, may also be utilized. The seal assembly 34 includes a conical sleeve portion 54 that surrounds the mandrel 42 and an engagement element 56 that is typically fashioned of elastomer for creating a sealing engagement with the wall of the wellbore 10. The lower end of the sleeve portion 54 is secured by set screw 57 and threads to a setting sleeve 58 that is releasably secured to the inner mandrel 42 by a set of shear pins 60. The hydraulic actuator 41 includes a cylinder 62 that radially surrounds the inner mandrel 42 and that is releasably secured to the setting sleeve 58 by a second set of shear pins 64. A hydraulic fluid chamber 66 is defined between the cylinder 62 and the inner mandrel 42. A fluid communication port 68 in the inner mandrel 42 allows fluid from the flowbore 44 to enter the fluid chamber 66. Fluid chamber 66 is sealed by annular fluid seals 70, 72, and 74. An annular piston member 76 and a body lock ring 78 are retained within the fluid chamber 66. The body lock ring 78 is a known component having a radially interior toothed surface that engages a ratchet-like outer surface on the inner mandrel 42.

The lower end of the cylinder 62 is secured by set screws 80 to a second body lock ring 82. The second body lock ring 82 is threadedly connected to a slip setting sleeve 84. The slip setting sleeve 84 features a plurality of ramped surfaces 86 that underlie the upper slip elements 36. An annular ring 88 interconnects the upper slip elements 36 to lower slip elements 38. The ring 88 is secured to upper slips 36 by a set of shear screws 89. It is noted that the slip elements 36 and 38 both have toothed outer surfaces for engaging the wall of the wellbore 10 and that both sets of slip elements 36, 38 can be moved radially outwardly independently of the other set. Slip setting sleeve 90 is located at the lower end of the lower slip elements 38 and presents a number of ramped surfaces 92 that underlie the slip elements 38. The slip setting sleeve 90 is retained in place by lower collar 94 and set screws 96. It should be understood that the use of two sets of slips is only one exemplary embodiment of an anchor. The use of two slip can facilitate design since each set of slips can be configured to engage and secure the packer in opposing axial direction. Other suitable arrangements could include one set of slips that secure the packer in both axial directions. In still other embodiments, an anchor may be omitted from the packer arrangement if, for example, the packer can be suitable suspended in the wellbore by other means.

Lower down on the packer assembly 30, is the lower assembly 40 (see FIGS. 2E-2F). The lower seal assembly 40 is similar to the upper seal assembly 34 in many respects. The seal assembly 40 includes a conical sleeve portion 98 that surrounds the lower inner mandrel 50 and an engagement element 100. Setting sleeve 102 is secured to the inner mandrel 50 by shear pins 104. Above the setting sleeve 102 is cylinder 106, which surrounds the lower inner mandrel 50. A lower hydraulic fluid chamber 108 is defined between the lower inner mandrel 50 and the cylinder 106. The fluid chamber 108 is sealed by fluid seals 110, 112 and 114. Piston 116 and body lock ring 118 reside within the fluid chamber 108, and fluid communication port 120 allows fluid to enter the fluid chamber 108 from the flowbore 44. A collar 122 and set screws 124 secure the cylinder 106 in place upon the mandrel 50. These elements can also be considered part of the hydraulic actuator 41. The lower end of the mandrel 50 has a sub portion 126 that is shaped and sized to fit within the seal bore 24 of the liner hanger 18.

It is noted that the different sets of shear pins 60, 64, 89, and 104 are provided with different shear values so that they require different amounts of axial force to shear. In one embodiment, shear pins 64 require the lowest amount of force to shear and will, therefore, shear first. Shear pins 89 require the next lowest amount of force to shear and will shear in response to a second, higher amount of force. Shear pins 104 require a higher level of force to shear than the shear pins 89, while shear pins 60 require the highest amount of force to shear and will, therefore, shear last. It should be understood that shear pins are merely representative of any number of frangible elements that are formed to fracture or disintegrate upon application of a predetermined amount of force.

Figure 4:
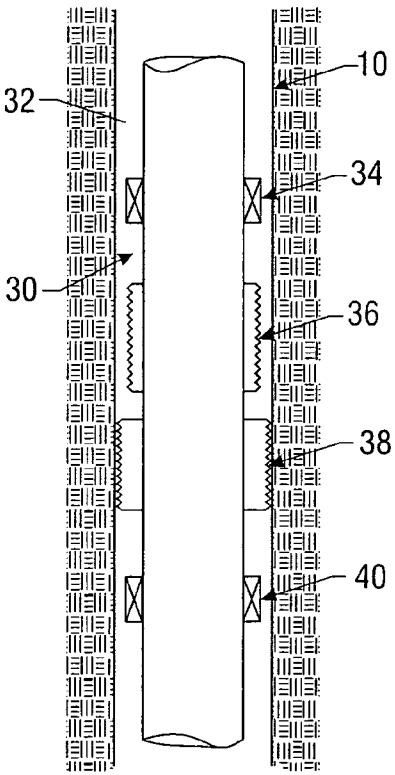
FIG. 4 is a schematic view of the packer assembly shown in a first, partially set position.
Figure 3:
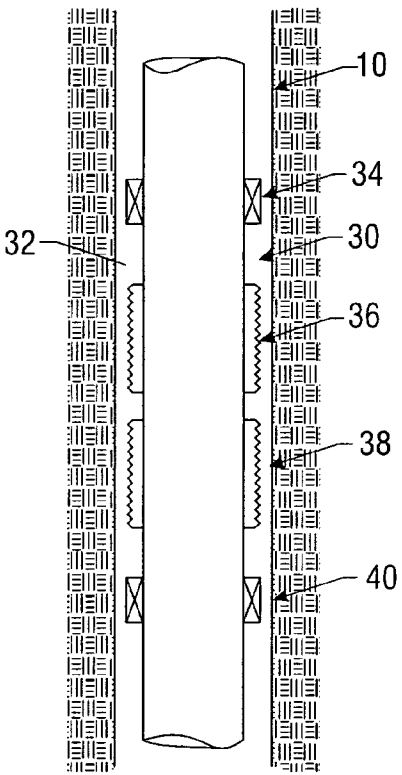
FIG. 3 is a schematic view of the packer assembly shown in FIGS. 2A-2F in a run-in position.
Figure 7:
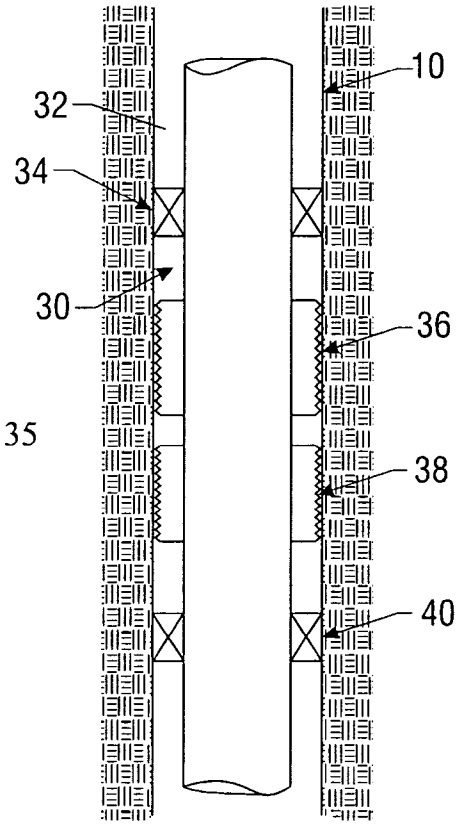
FIG. 7 is a schematic view of the packer assembly now in a fully set position.
Figure 6:
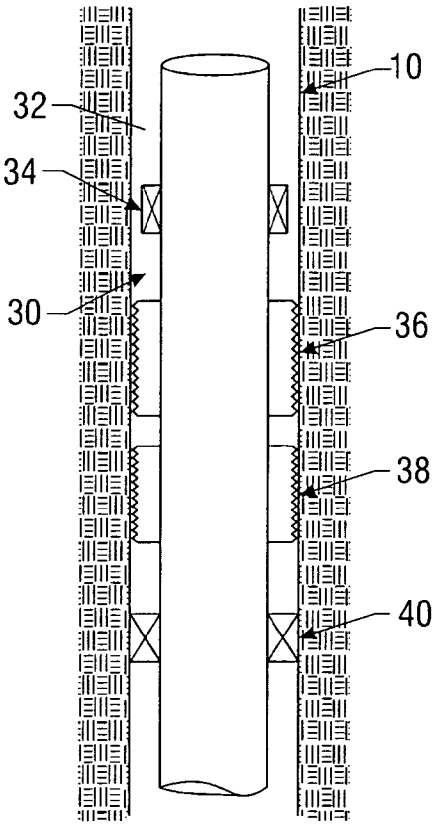
FIG. 6 is a schematic view of the packer assembly in a third, partially set position.

In operation, the production tubing string 28 and affixed packer assembly 30 are lowered into the wellbore 10 to a location where it is desired to set the packer assembly 30. The sub portion 126 of the packer assembly 30 is disposed, at least partially, into the seal bore 24 of the liner hanger 18. Actuation of the packer assembly 30 is accomplished by flowing pressurized hydraulic fluid through the production tubing 28 and into the flowbore 44 within the packer assembly 30. The pressurized fluid actuates the hydraulic actuator 41 upon entering the two fluid chambers 66 and 108 via ports 68, 120, respectively. As fluid pressure is increased within the flowbore 44 and the two fluid chambers 66, 108, the shear pins 64, 89,104, 60 will shear in order, thereby causing the slips 36, 38 and the seal assemblies 34, 40 to become set in a predetermined order. This process is best understood with further reference to FIGS. 3-7, which schematically illustrate the staged setting process for the packer assembly 30. When the packer assembly 30 is run into the wellbore 10, it is initially in the position depicted in FIG. 3 with neither of the slip elements 36, 38 set and neither of the seals 34, 40 set. As pressure in the flowbore 44 is increased to a first level, shear screws 64 will shear, allowing the cylinder 62 to be released from the setting sleeve 58. Fluid pressure within the upper hydraulic fluid chamber 66 will cause the cylinder 62, lock ring 82, slip setting sleeve 84, upper slips 36, ring 88 and lower slips 38 to all move axially downwardly upon the inner mandrel 42. The upper slips 36 are not set by the setting sleeve 84 at this point due to their restraint by shear pins 89. However, the lower slips 38 are urged radially outwardly by the ramped surfaces 92 of the lower slip setting sleeve 90 and into engagement with the wall of the wellbore 10. Now the packer assembly 30 is in the position illustrated by FIG. 4.

When pressure within the flowbore 44 is further increased to a second predetermined level, the shear screws 89 will be sheared, thereby allowing the upper slips 36 to be urged outwardly by the ramped surfaces 86 of the upper slip setting sleeve 84. The upper slips 36 will be brought into contact with the wall of the wellbore 10, and at this point, the packer assembly 30 will be in the position illustrated in FIG. 5 with both sets of slips 36, 38 now set and neither seal element 34, 40 set.

Fluid pressure within the flowbore 44 is now increased to a further level that is sufficient to shear the third set of shear screws 104. This frees the lower setting sleeve 102 from connection to the cylinder 106. Fluid pressure within the lower fluid chamber 108 will urge the setting sleeve 102 downwardly along with the affixed sleeve portion 98 and seal element 100. Ramped surface 52 will urge the seal element 100 radially outwardly and into contact with the wall of the wellbore 10 in order to establish a fluid seal. At this point, the packer assembly 30 is in the configuration depicted in FIG. 6, with both slips 36, 38 set and the lower seal assembly 40 now set.

Finally, fluid pressure within the flowbore 44 is then increased still further to a level that is sufficient to shear the final set of shear screws 60. When this occurs, the upper setting sleeve 58, sleeve portion 54 and seal element 56 are freed to move axially upwardly upon the inner mandrel 42. The ramped surface 46 causes the seal element 56 to be urged radially outwardly and brought into contact with the wellbore 10 wall. Now, the packer assembly 30 is in the position shown in FIG. 7 with both sets of slips 36, 38 and both seal assemblies 34, 40 deployed within the wellbore 10. As can be seen, a hydraulic chamber or cavity 35 has been formed by the seal assemblies 34, 40 and the body of the packer.

The staged or sequential setting process for the packer assembly 30 can be advantageous. Setting of the slips 36, 38 first, allows the packer assembly 30 to be mechanically anchored within the wellbore 10 before the seal assemblies 34, 40 are set, thereby assuring that the seal assemblies 34, 40 will be set where intended and without axial slippage. Also, when seal assemblies 34, 40 are set, it is known that they physically displace fluid in the annulus 32. If both seal assemblies were to be set at the same time, mutual displacement of fluid within the annulus 32 might result in incomplete setting of both assemblies 34, 40. Once this upward movement of fluid has equalized, the upper slip assembly 34 can be set thereafter.

As noted previously, fluid seal redundancy is provided by the use of two seal assemblies 34, 40. Both seals provide barriers that prevent fluid migration across the packer assembly 30. The packer assembly 30 adds a premium seal barrier beyond what conventional assemblies are believed to provide. Additionally, wellbore fluids trapped in the annulus 32 between the two seal assemblies 34, 40 will actually improve the fluid sealing capability of the packer assembly 30. As the fluid heats up during subsequent production, it expands and enhances the seal created by the two seal assemblies 34, 40 by the exertion of fluid pressure against them.

The dual seal assembly also serves to hydraulically isolate the hydraulic actuation portions of the packer assembly 30 from wellbore fluids in the annulus 32. In the event that one or more of the O-ring seals 70, 72, 74, or 110, 112, 114 fails, tubing fluid in the fluid chambers 66, 108 might leak into the annulus 32. The seal assemblies 34, 40 will contain this fluid with the hydraulic cavity or chamber 35.

It is noted that in this embodiment the setting of the packer assembly 30 is a permanent set due to the action of the body lock rings 78, 82, 118, which maintain the assembly 30 in the set position. However, it should be understood that the packer assembly 30 can also be retrievable. For example, elements such as the slips and seals can be adapted to retract or otherwise disengage from the wall to which they are engaged. Once disengaged, the packer assembly 30 can be retrieved utilizing a suitable work string.

The foregoing description is directed to particular embodiments of the present invention for the purpose of illustration and explanation. It will be apparent, however, to one skilled in the art that many modifications and changes to the embodiment set forth above are possible without departing from the scope of the invention.

What is claimed is:

1. A packer assembly for use within a wellbore, comprising:

a body;

a first seal element and a second seal element positioned on the body, the first and second seal elements creating a fluid seal between the body and an adjacent wall when set;

an anchor positioned on the body, the anchor engaging the adjacent wall when set to thereby secure the body in the wellbore; and a hydraulic actuator adapted to set one of (i) the first seal element, (ii) the second seal element, and (iii) the anchor, wherein the first and second seal elements form a hydraulic chamber that substantially isolates any fluid that may leak out of the hydraulic actuator.

2. The packer assembly of claim 1 wherein the hydraulic actuator is positioned between the first seal element and the second seal element.

3. The packer assembly of claim 1 wherein the seal elements are sequentially set.

4. The packer assembly of claim 1 wherein the anchor is located axially between the first and second seal elements.

5. The packer assembly of claim 1 wherein the anchor comprises a first and second set of slips.

6. The packer assembly of claim 1 wherein the first seal element, the and second seal element, and the anchor are adapted to be unset, the packer assembly thereby being retrievable.

7. A packer assembly for use within a wellbore, comprising:

a body;

a first seal element and a second seal element positioned on the body, the first and second seal elements creating a fluid seal between the body and an adjacent wall when set;

an anchor positioned on the body, the anchor engaging the adjacent wall when set to thereby secure the body in the wellbore; wherein the seal elements are sequentially set using a progressive increase in fluid pressure.

8. A packer assembly for use within a wellbore, comprising:

a body:

a first seal element and a second seal element positioned on the body, the first and second seal elements creating a fluid seal between the body and an adjacent wall when set;

an anchor positioned on the body, the anchor engaging the adjacent wall when set to thereby secure the body in the wellbore; wherein heating of the fluid trapped between the first and second seal elements increases the sealing effect of the first and second seal elements.

9. A method for deploying a packer in a wellbore, comprising:

securing a packer body in the wellbore by setting an anchor;

forming a first and second seal between the body and an adjacent wall by setting a first and second seal;

actuating a hydraulic actuator to set one of (i) the first seal, (ii) the second seal, and (iii) the anchor; and substantially isolating any fluid that may leak out of the hydraulic actuator by forming a hydraulic chamber with the first and second seal.

10. The method of claim 9 further comprising sequentially setting the first and second seals.

11. The method of claim 9 further comprising retrieving the packer body from the wellbore.

12. The method of claim 9 further comprising locating the anchor axially between the first and second seals.

13. The method of claim 9 further comprising positioning the hydraulic actuator between the first seal and the second seal.

14. A method for deploying a packer in a wellbore, comprising:

securing a packer body in the wellbore by setting an anchor;

forming a first and second seal between the body and an adjacent wall by setting a first and second seal;

sequentially setting the first and second seals by progressively increasing fluid pressure in the wellbore.

15. An apparatus for use in a wellbore, comprising:

a body adapted to be secured within a wellbore;

a first seal element and a second seal element positioned on the body, the first and second seal elements expanding into sealing engagement with an adjacent wall, a substantially isolated hydraulic chamber thereby being formed by the body, the first expanded seal element, and the second expanded seal element; and a hydraulic actuator adapted to expand the first and second seal elements, wherein the hydraulic chamber substantially isolates any fluid that may leak out of the hydraulic actuator.

16. The apparatus of claim 15 further comprising a set of slips that secure the body to the wellbore when set.

17. The apparatus of claim 15 wherein the body is adapted to be retrieved from the wellbore.

18. The apparatus of claim 15 further comprising an anchor that secures the body to the wellbore when set.

19. The apparatus of claim 18 wherein the anchor is located axially between the first and second seal elements.

20. The apparatus of claim 15 wherein the hydraulic actuator is positioned between the first seal element and the second seal element.

* * * * *